US009486908B2

(12) United States Patent
Dougherty

(10) Patent No.: US 9,486,908 B2
(45) Date of Patent: Nov. 8, 2016

(54) ROTARY IMPACT TOOL

(71) Applicant: Ingersoll-Rand Company, Davidson, NC (US)

(72) Inventor: Thomas S. Dougherty, Nazareth, PA (US)

(73) Assignee: Ingersoll-Rand Company, Davidson, NC (US)

( * ) Notice: Subject to any disclaimer, the term of this patent is extended or adjusted under 35 U.S.C. 154(b) by 655 days.

(21) Appl. No.: 13/920,290

(22) Filed: Jun. 18, 2013

(65) Prior Publication Data

US 2014/0367130 A1 Dec. 18, 2014

(51) Int. Cl.
*B25D 17/26* (2006.01)
*B25B 21/02* (2006.01)

(52) U.S. Cl.
CPC ..... *B25D 17/26* (2013.01); *B25B 21/026* (2013.01)

(58) Field of Classification Search
CPC ..... B25B 21/026; B25D 17/26
USPC ..... 173/1, 93; 81/464
See application file for complete search history.

(56) References Cited

U.S. PATENT DOCUMENTS 3,162,268 A 12/1964 Short
3,822,001 A 7/1974 Sides
3,929,195 A 12/1975 Stiltz et al.
4,175,408 A 11/1979 Asakura et al.
4,287,956 A * 9/1981 Maurer ..... B25B 21/026 173/93.5
4,576,240 A 3/1986 Matsumoto
6,722,449 B2 4/2004 LeBisch et al.
6,732,815 B2 5/2004 Hanke et al.
6,929,098 B2 8/2005 Ilmarinen et al.
7,328,753 B2 2/2008 Henriksson et al.
7,331,404 B2 * 2/2008 Pusateri ..... B25B 21/02 173/93
7,654,338 B2 2/2010 Berghauser et al.
7,814,986 B2 10/2010 Berghauser et al.
8,196,674 B2 6/2012 Arakawa et al.
2005/0224243 A1 10/2005 Baumann et al.
2006/0144601 A1 * 7/2006 Pusateri ..... B25B 21/02 173/1
2007/0131070 A1 * 6/2007 Hull ..... B25B 13/461 81/489
2007/0298707 A1 * 12/2007 Bosch ..... F24F 11/053 1/53
2009/0223690 A1 9/2009 Nagasaka et al.
2010/0071924 A1 3/2010 Schoeps
2010/0287977 A1 * 11/2010 Wagner ..... F04B 23/04 62/468
2011/0150690 A1 * 6/2011 Tang ..... F04C 18/0215 418/55.6
2012/0125650 A1 5/2012 Koch et al.
2012/0292065 A1 11/2012 Hoshi et al.

FOREIGN PATENT DOCUMENTS

EP 1614507 A2 1/2006
WO 2012079858 A1 6/2012

* cited by examiner

*Primary Examiner* — Hemant M Desai
*Assistant Examiner* — Valentin Neacsu
(74) *Attorney, Agent, or Firm* — Barnes & Thornburg LLP

(57) ABSTRACT

In at least one illustrative embodiment, a rotary impact tool comprises a motor including a rotor and an input shaft coupled to the rotor for rotation therewith about an input axis, an anvil configured to be rotated about an output axis and including an output shaft, a carrier driven by the input shaft and having a passage extending through a distal end thereof, and a hammer supported and driven by the carrier and configured to impact the anvil to cause the anvil to rotate about the output axis. The anvil may comprise a blade coupled to the output shaft and configured to direct a lubricating fluid through the passage when the anvil or carrier rotates about the output axis.

17 Claims, 9 Drawing Sheets

ROTARY IMPACT TOOL

TECHNICAL FIELD

The present disclosure relates, generally, to rotary tools including impact mechanisms (impact drivers, impact wrenches, etc.). More particularly, the present disclosure relates to an impact mechanism having a rotating hammer that repeatedly strikes an anvil coupled to a shaft.

BACKGROUND

Rotary impact tools are used to tighten or loosen fasteners. Rotary impact tools often include a drive motor with a motor shaft, a hammer driven by the motor shaft, and an anvil that is impacted by the hammer so that the anvil is rotated and thereby drives a fastener. Most impact mechanisms are configured to transmit high-torque rotational force to the anvil (and subsequently a fastener) while requiring relatively low-torque reaction forces be absorbed by the motor and/or an operator holding the rotary impact tool. More specifically, by using the motor to repeatedly accelerate the hammer while it is out of contact with the anvil and then bringing the hammer only briefly into contact with the anvil, the anvil is imparted with a high-torque rotational force from the hammer impacts while the motor is exposed to low-torque reaction forces corresponding generally to the free acceleration of the hammer.

SUMMARY

According to one aspect, a rotary impact tool may include a motor including a rotor and an input shaft coupled to the rotor for rotation therewith about an input axis, an anvil configured to be rotated about an output axis and including an output shaft, a carrier driven by the input shaft and having a passage extending through a distal end thereof, and a hammer supported and driven by the carrier and configured to impact the anvil to cause the anvil to rotate about the output axis. The anvil may include a blade coupled to the output shaft and configured to direct a lubricating fluid through the passage when the anvil or carrier rotates about the output axis.

In some embodiments, the passage may extend at an angle between first and second surfaces of a support at the distal end of the carrier.

In some embodiments, the carrier may include a plurality of passages extending through the distal end thereof.

In some embodiments, the blade may include a leading surface and a trailing surface and may be configured such that, when the anvil rotates in a first direction, the leading surface leads to pull lubricating fluid inwardly toward the leading surface and downwardly into the passage.

In some embodiments, the anvil may further include a second blade coupled to the output shaft diametrically opposite the blade. The second blade may include a second leading surface and a second trailing surface.

In some embodiments, the second blade may be configured such that, when the anvil is rotated in the first direction, the second leading surface of the second blade also leads to pull lubricating fluid inwardly toward the second leading surface and downwardly into the passage.

In some embodiments, the second blade may be configured such that, when the anvil is rotated in the first direction, the second trailing surface leads and, when the anvil is rotated in a second direction opposite the first direction, the second leading surface leads.

In some embodiments, the blade may extend outwardly at an angle relative to the anvil and may be configured such that, when the anvil is rotated in a first direction, lubricating fluid is pulled inwardly between the blade and the anvil and downwardly into the passage.

In some embodiments, the blade may be substantially planar and angled with respect to the carrier.

In some embodiments, the blade may extend outwardly from a ring having a central keyed passage that mates with a keyed structure on the anvil.

According to another aspect, a drive train may include an input shaft rotatable about an input axis, an anvil configured to rotate about an output axis, the anvil including an output shaft, a carrier driven by the input shaft and having a passage extending through a distal end thereof, and an impactor including a hammer supported and driven by the carrier and configured to impact the anvil to cause the anvil to rotate about the output axis. The anvil may include a blade coupled to the output shaft and configured to direct a lubricating fluid through the passage when the anvil or carrier rotates about the output axis.

In some embodiments, the blade may include a concave surface and a convex surface and may be configured such that, when the anvil rotates in a first direction, the concave surface leads to pull lubricating fluid inwardly toward the concave surface and downwardly into the passage.

In some embodiments, the anvil may further include a second blade diametrically opposite the blade. The second blade may include a second concave surface and a second convex surface.

In some embodiments, the second blade may be configured such that, when the anvil is rotated in the first direction, the second concave surface of the second blade also leads to pull lubricating fluid inwardly toward the second concave surface and downwardly into the passage.

In some embodiments, the second blade may be configured such that, when the anvil is rotated in the first direction, the second convex surface leads and, when the anvil is rotated in a second direction opposite the first direction, the second concave surface leads.

In some embodiments, the blade may extend outwardly at an angle relative to the anvil and is configured such that, when the anvil is rotated in a first direction, lubricating fluid is pulled inwardly between the blade and the anvil and downwardly into the passage.

In some embodiments, the blade may extend outwardly from a ring having a central keyed passage that mates with a keyed structure on the anvil.

According to yet another aspect, a method of moving a lubricating fluid into an impact mechanism of a rotary impact tool may include rotating an input shaft about an input axis, translating rotational movement from the input shaft to a carrier, which drives a hammer supported by the carrier, wherein the carrier includes a passage extending through a distal end of the carrier, impacting an anvil with the hammer, thereby causing the anvil to rotate about an output axis, wherein the anvil includes an output shaft and a blade coupled to the output shaft, and directing a lubricating fluid through the passage as the anvil or carrier rotates about the output axis.

In some embodiments, directing the lubricating fluid through the passage may include using the blade to pull the lubricating fluid inwardly toward the blade and downwardly into the passage while the anvil is rotated in a first direction.

In some embodiments, directing the lubricating fluid through the passage may include using a second blade coupled to the output shaft to pull the lubricating fluid inwardly toward the second blade and downwardly into the passage while the anvil is rotated in a second direction opposite the first direction.

BRIEF DESCRIPTION OF THE DRAWINGS

The concepts described in the present disclosure are illustrated by way of example and not by way of limitation in the accompanying figures. For simplicity and clarity of illustration, elements illustrated in the figures are not necessarily drawn to scale. For example, the dimensions of some elements may be exaggerated relative to other elements for clarity. Further, where considered appropriate, reference labels have been repeated among the figures to indicate corresponding or analogous elements.

DETAILED DESCRIPTION OF THE DRAWINGS

Figure 1:
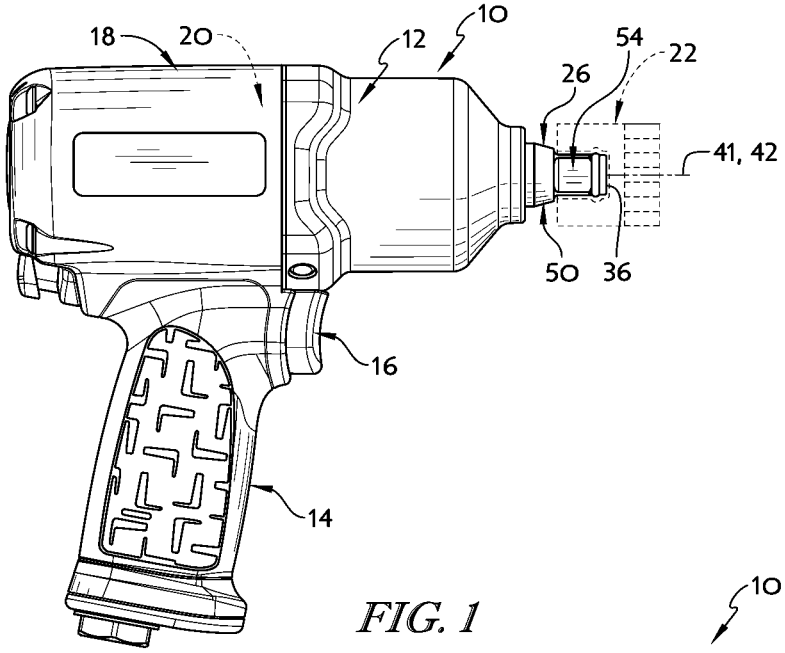
FIG. 1 is a side elevation view of an illustrative impact tool.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the present disclosure.

Referring now to FIG. 1, an impact tool 10 for driving a fastener is shown. The impact tool 10 includes a casing 12 having a handle 14, a trigger 16 coupled to the handle to move relative to the handle 14, and a body 18 extending from the handle 14. The body 18 houses a drive train 20 configured to rotate a socket 22 (shown in phantom) which, in turn, tightens or loosens a fastener such as a bolt, a nut, a screw or the like. The drive train 20 is activated by a user pressing the trigger 16.

Figure 2:
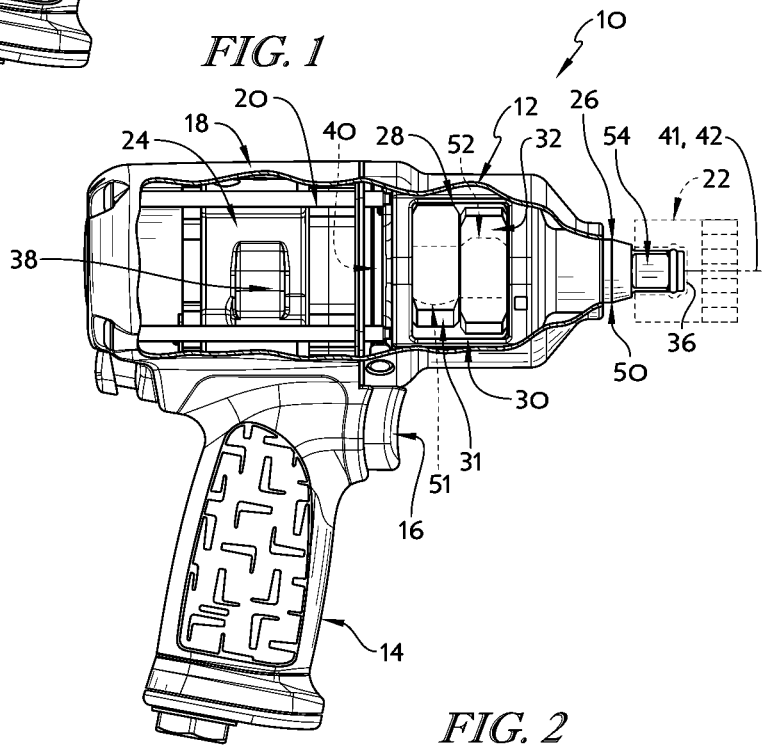
FIG. 2 is a partially cutaway view showing a drive train included in the impact tool of FIG. 1.

Turning to FIG. 2, a portion of the casing 12 is broken away to show the drive train 20. In the illustrative embodiment, the drive train 20 includes a motor 24, an anvil 26, and an impactor 28 having two hammers 31, 32 that impart repeated blows onto the anvil 26 causing the anvil 26 to rotate. The motor 24 is illustratively an air motor but in other embodiments may be an electric motor powered by a battery or a wired power outlet. The impactor 28 is illustratively rotated by the motor 24, causing the hammers 31, 32 of the impactor 28 to strike the anvil 26 as the impactor 28 is rotated. The anvil 26 has a proximal end 34 arranged near the impactor 28 and a distal end 36 configured to be mated with a fastener driver, such as the socket 22 (shown in phantom).

The motor 24 includes a rotor 38, and a motor shaft 40 as shown in FIG. 2. The rotor 38 is coupled to and drives the motor shaft 40 for rotation about a motor axis 41. The motor shaft 40 is coupled to the impactor 28 of the drive train and rotates the impactor 28 about an output axis 42. In the illustrative embodiment, the motor axis 41 and the output axis 42 are collinear so that the momentum of the rotor is applied to the hammers 31, 32 when the hammers 31, 32 are brought into contact with the anvil 26 to rotate the anvil 26.

Figure 3:
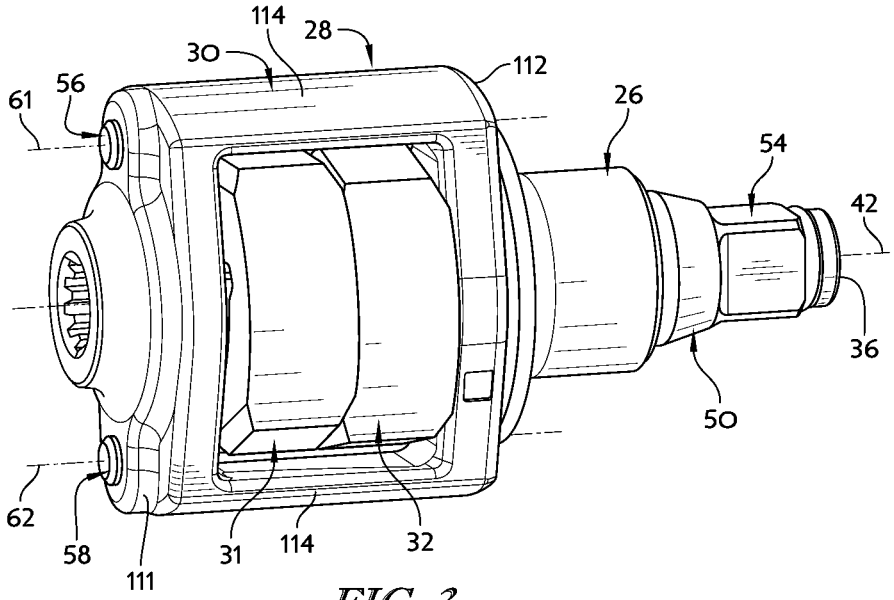
FIG. 3 is a perspective view of an anvil, a carrier, and two hammers included in the drive train of FIG. 2.
Figure 4:
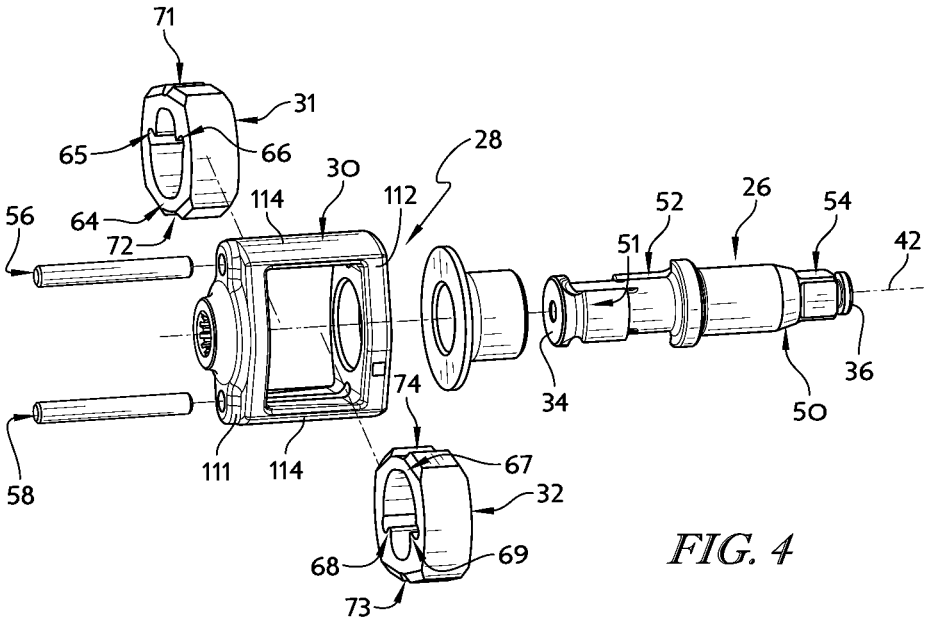
FIG. 4 is an exploded view of the anvil, the carrier, and the two hammers of FIG. 3.
Figure 5:
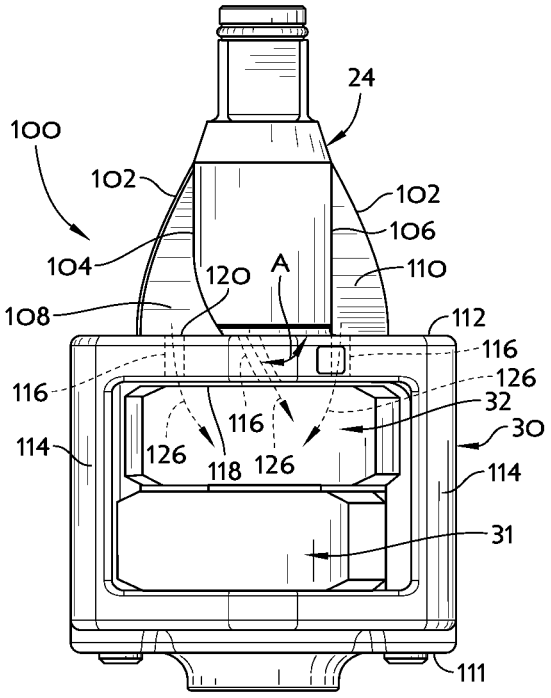
FIG. 5 is a side elevation view of the anvil, the carrier, and the two hammers of the drive train of FIGS. 3 and 4, and including a first embodiment of a lubrication system including blades extending from the anvil and passages extending through the carrier for movement of a fluid into the carrier and the two hammers.
Figure 6:
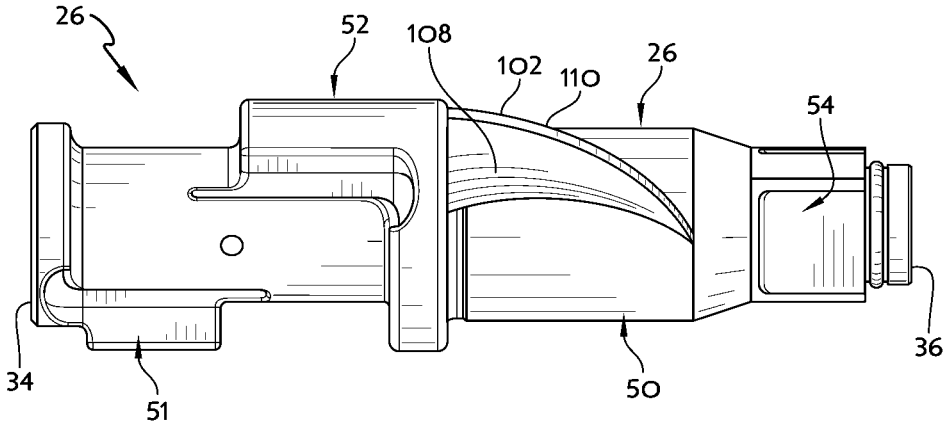
FIG. 6 is a side elevation view at the anvil of FIG. 5.

Referring now to FIGS. 3 and 4 the anvil 26 extends through a portion of the impactor 28 and is illustratively a monolithically formed component. The anvil 26 includes a central output shaft 50, an aft lug 51, and a forward lug 52 as shown in FIGS. 4-5. The central output shaft 50 is mounted for rotation about the output axis 42 and is formed to include a connector end 54 located at the distal end 36 of the anvil 26 that is adapted to couple to a fastener driver, such as the socket 22 shown in FIGS. 1 and 2. The aft lug 51 is located near the proximal end 34 of the anvil 26, as shown in FIG. 4. The forward lug 52 is located between the aft lug 51 and the distal end 36 of the anvil 26.

In the illustrative embodiment, each lug 51, 52 of the anvil 26 illustratively extends a similar distance outward in a radial direction from the output shaft 50 and extends a similar distance in an axial direction along the output shaft 50 as suggested in FIG. 4. In the illustrative embodiment, the lugs 51, 52 are spaced apart from one another along the output shaft 50 in the circumferential and axial directions as suggested in FIG. 4. Additionally, in the illustrative embodiment, the aft lug 51 is arranged circumferentially opposite the forward lug around the output shaft 50.

The impactor 28 illustratively includes a carrier 30, an aft hammer 31, and a forward hammer 32, as shown in FIGS. 3 and 4. The carrier 30 is illustratively coupled to the motor shaft 40 and is driven by the motor shaft 40 about the output axis 42 (and, in the illustrative embodiment, the motor axis 41). The aft hammer 31 is coupled to the carrier 30 by a pin 56 for rotation relative to the carrier 30 about an aft hammer axis 61. The forward hammer 32 is coupled to the carrier 30 by a pin 58 for rotation relative to the carrier 30 about a forward hammer axis 62, as seen in FIG. 3.

In the illustrative embodiment, each hammer 31, 32 is hollow and extends around the anvil 26, as shown in FIGS. 2 and 3. The aft hammer 31 includes an outer ring 64 and a pair of impact jaws 65, 66 that extend inward in the radial direction from the outer ring 64, as shown in FIG. 4. Similarly, the forward hammer 32 includes an outer ring 67 and a pair of impact jaws 68, 69 that extend inward in the radial direction from the outer ring 67. The outer ring 64 of the aft hammer 31 extends around the output shaft 50 and the aft lug 51 of the anvil 26 so that the impact jaws 65, 66 of the aft hammer 31 are configured to impart repeated blows onto the aft lug 51 during rotation of the carrier 30. The outer ring 67 of the forward hammer 32 extends around the output shaft 50 and the forward lug 52 of the anvil 26 so that the impact jaws 68, 69 of the forward hammer 31 are configured to impart repeated blows onto the forward lug 52 during rotation of the carrier 30.

The aft hammer 31 is formed to include a first notch 71 and a second notch 72 each extending inward in the radial direction into the outer ring 64 as shown in FIG. 4. The first notch 71 is configured to receive the pin 56 so that the aft hammer 31 pivots about the pin 56 relative to the carrier 30. The second notch 72 is arranged substantially opposite the first notch 71 and is configured to receive the pin 58 and to allow movement of the aft hammer 31 relative to the pin 58 during rotation of the aft hammer 31 relative to the carrier 30.

The forward hammer 32 is similar to the aft hammer 31 and is formed to include a first notch 73 and a second notch 74 each extending inward in the radial direction into the outer ring 67 as shown in FIG. 4. The first notch 73 is configured to receive the pin 58 so that the forward hammer 32 pivots about the pin 58 relative to the carrier 30. The second notch 74 is arranged substantially opposite the first notch 73 and is configured to receive the pin 56 and to allow movement of the forward hammer 32 relative to the pin 56 during rotation of the forward hammer 32 relative to the carrier 30. Additional description of the operation of the hammers 31, 32 included in the impactor 28 is described in U.S. Pat. No. 4,287,956, filed Aug. 10, 1979, the entirety of which is incorporated herein by reference.

A number of embodiments of a lubrication system are disclosed herein. During use of the impact tool 10, a lubricating fluid, such as oil or grease, used to lubricate the hammers 31, 32 of the impactor 28, escapes from the carrier 30. The lubrication systems described herein illustratively pull displaced lubricating fluid back into the impactor 28.

A first embodiment of a lubrication system 100 is depicted in FIGS. 5-8. The lubrication system 100 includes a set of blades 102 extending outwardly from diametrically opposite sides 104, 106 of the anvil 26. While two blades 102 are depicted diametrically opposite one another, any number of blades 102 may be used and/or the blades 102 may be disposed symmetrically or asymmetrically about the anvil 26. As illustratively seen in FIG. 8, each of the blades 102 is an auger-type blade that includes a concave surface 108 and a convex surface 110. In the illustrative embodiment of FIGS. 5-8, the concave surfaces 108 of the blades 102 lead (as opposed to the convex surfaces 110) when the anvil 26 is rotated in a counterclockwise direction. The blades 102 of the embodiment of FIGS. 5-8 are uni-directional in that they only pull displaced lubricating fluid back into the impactor 28 when moved in a single direction (illustratively counterclockwise). In an alternative embodiment, the concave and convex surfaces 108, 110 of the blades 102 may be reversed so the concave surfaces 108 lead when rotated in a clockwise direction.

The carrier 30 generally includes an aft support 111 and a forward support 112 joined by opposing arms 114, as seen in FIGS. 3-5 and 7. A plurality of passages 116 extend through the forward support 112 from an aft surface 118 to a forward surface 120 of the forward support 112, as suggested in FIG. 5. In an illustrative embodiment, as seen in FIGS. 5-8, the carrier 30 includes four passages 116 that may be symmetrically placed on opposite sides of the carrier 30. Optionally, any number of passages 116 may be utilized and the passages 116 may be of any size. Still alternatively, the passages 116 may be positioned, either symmetrically or asymmetrically, at any locations around the forward support 112. Additionally, while the passages 116 are shown as having a circular cross-section, one or more of the passages 116 may have other cross-sectional shapes, such as rectangular, oval, square-shaped, or any other geometric shape.

Figure 7:
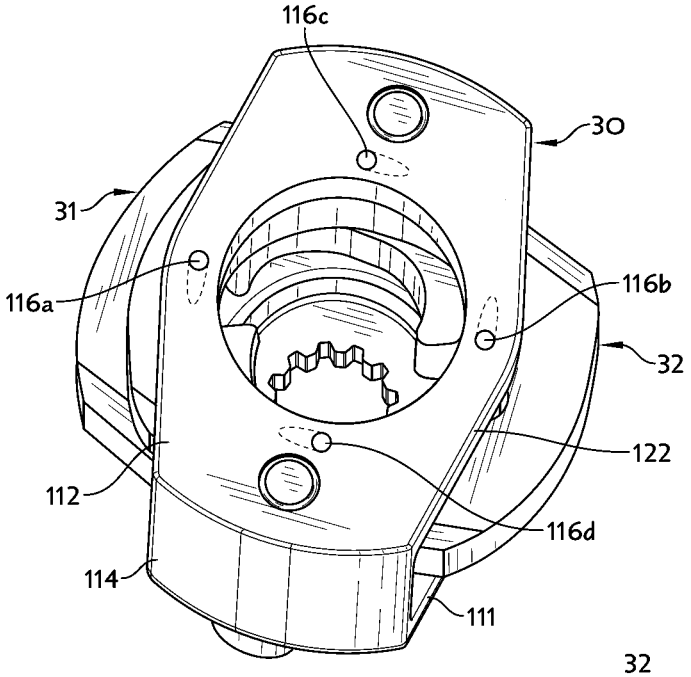
FIG. 7 is a top perspective view of the carrier of FIG. 5 and depicting the passages extending through the carrier.

Referring to FIGS. 5 and 7, in an illustrative embodiment, the passages 116 are angled to direct lubricating fluid to the proper location within the impactor 28. In an illustrative embodiment, one or more of the passages 116 may be angled in the counterclockwise direction of travel of the anvil 26. In the illustrative embodiment, the passages 116 may be angled from the forward surface 120 of the forward support 112 toward the aft surface 118 of the support 112 in the counterclockwise direction (as seen with passages 116*a*, 116*b*). If the concave and convex surfaces 108, 110 are reversed and the direction of travel is reversed (to be clockwise), the passages 116 may be angled from the forward surface 120 of the forward support 112 toward the aft surface 118 of the support 112 in a clockwise direction (as seen with passages 116*c*, 116*d*). In another illustrative embodiment, one or more passages 116 may be angled in a clockwise direction (116*c*, 116*d*) and one or more passages 116 may be angled in a counterclockwise direction (116*a*, 116*b*). Still alternatively, one or more of the passages 116 may be angled outwardly toward an outer edge 122 of the forward support 112.

In an illustrative embodiment, one or more of the passages 116 may be disposed at an angle A (see FIG. 5) of between about 25 and about 45, or between about 30 degrees and about 40 degrees. In other illustrative embodiments, the angle A may be about 25 degrees, about 30 degrees, about 35 degrees, about 40 degrees, or about 45 degrees. In a further alternative illustrative embodiment, the angle A of one or more passages 116 may be dependent upon an angle of the blades 102. In an illustrative embodiment, a relationship between the angle A of the passages 116 and an angle of the blades 102 may vary.

Figure 8:
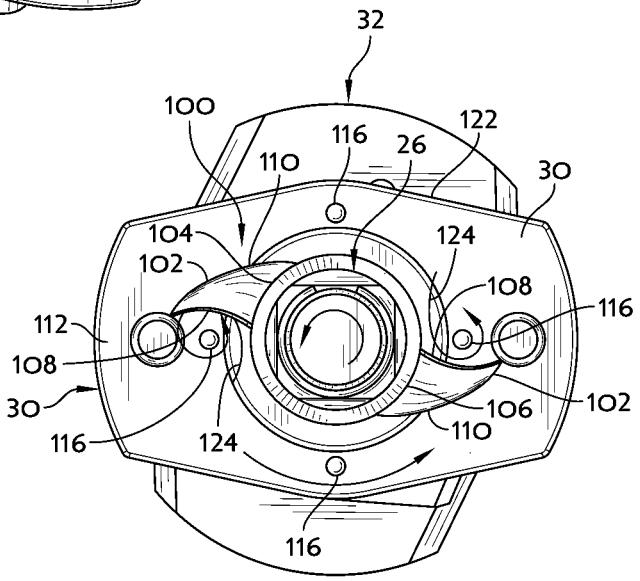
FIG. 8 is a top elevation view of the anvil, the carrier, and the hammers of FIG. 5, and depicting a location of the passages in the carrier in relation to the blades on the anvil.

When the anvil 26 is rotated in a counterclockwise direction, as seen in FIG. 8, the concave surfaces 108 lead in that they are the first surfaces of the blades 102 to encounter lubricating fluid that has escaped from the carrier 30. In this manner, the movement of the blades 102 and the shape of the concave surfaces 108 pull the lubricating fluid inwardly toward the anvil 26, as indicated by arrows 124 and into and through the passages 116, as indicated by arrows 126, as suggested by FIG. 5.

Figure 9:
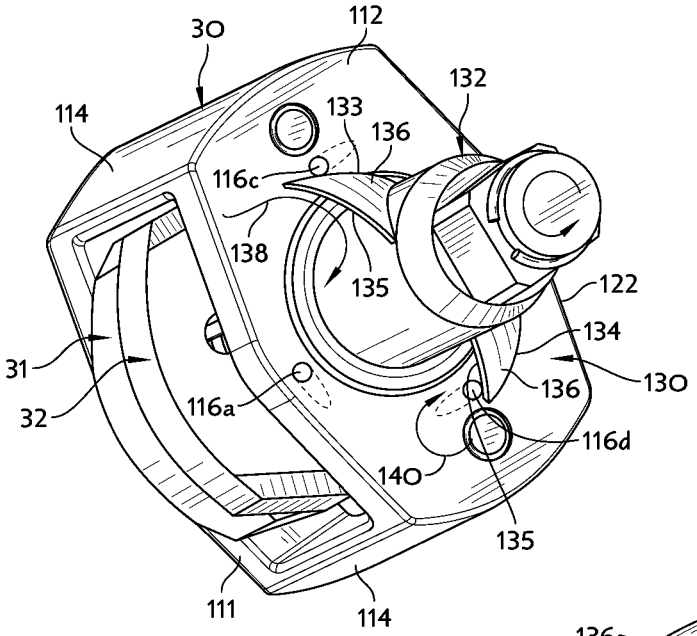
FIG. 9 is a top perspective view of a second embodiment of a lubrication system including blades extending from the anvil and passages extending through the carrier, and further depicting movement of a lubricating fluid upon rotation of the anvil in a counterclockwise direction.
Figure 10:
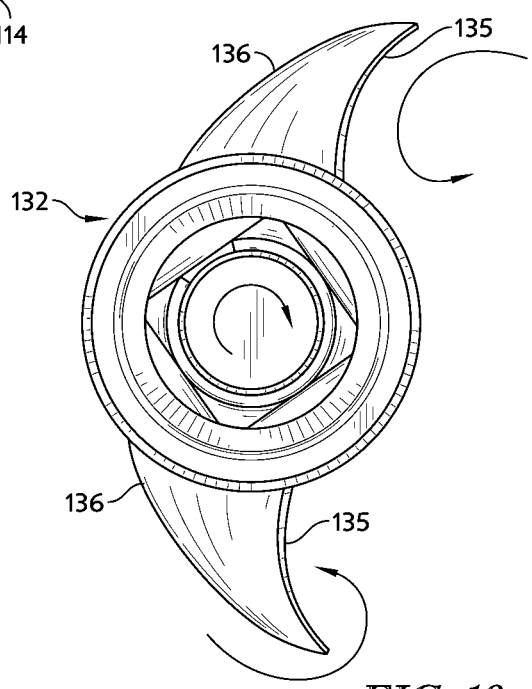
FIG. 10 is a top elevation view of the anvil of FIG. 9.

A second illustrative embodiment of a lubrication system 130 is depicted in FIGS. 9 and 10. The carrier 30 of FIGS. 9 and 10 may be similar to the carrier 30 described with respect to FIGS. 5-8, including the passages 116. The anvil 132 of FIGS. 9 and 10 is similar to the anvil 26 of FIGS. 5-8 except that the anvil 132 includes opposing blades 133, 134 having concave and convex surfaces 135, 136, wherein at least one blade 134 has a concave surface 136 that leads in the clockwise direction of travel and at least one blade 133 that has a concave surface 136 that leads in the counterclockwise direction of travel. In this manner, the blades 133, 134 are bi-directional and, if the direction of travel of the anvil 132 is changed from clockwise to counterclockwise, at least one of the blades 133, 134 still functions to pull lubricating fluid in and down through the one or more passages 116, as described in greater detail above.

In the illustrative embodiment of FIGS. 9 and 10, one or more of the passages 116 may be angled in the clockwise direction and one or more of the passages 116 may be angled in the counterclockwise direction. Alternatively, the passages 116 may be angled in any manner described above with respect to the embodiment of FIGS. 5-8.

When the anvil 132 is rotated in a counterclockwise direction, as seen in FIG. 9, the concave surface 135 of the blade 133 encounters the lubricating fluid that has escaped from the carrier 30 and pulls the lubricating fluid inwardly toward the anvil 132 and down into the passages 116, as indicated by arrow 138 in FIG. 9. During this movement, the blade 134 creates an eddy, as indicated by arrow 140 in FIG. 9. Similarly, if the anvil 132 is rotated in a clockwise direction, the blade 134 pulls the lubricating fluid inwardly toward the anvil 132 and down into the passages 116 and the blade 133 creates an eddy.

Figure 11:
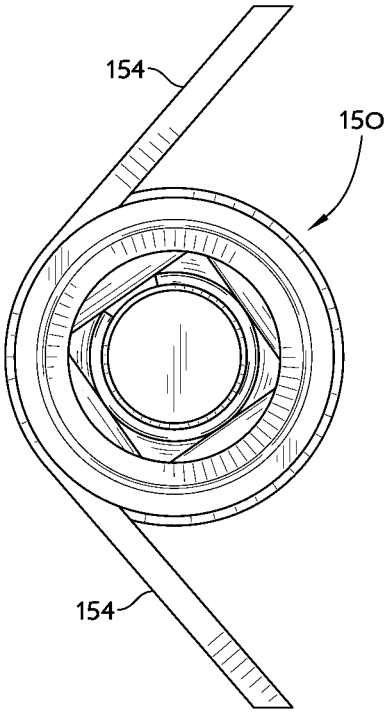
FIG. 11 is a top elevation view depicting an anvil of a third embodiment of a lubrication system.
Figure 12:
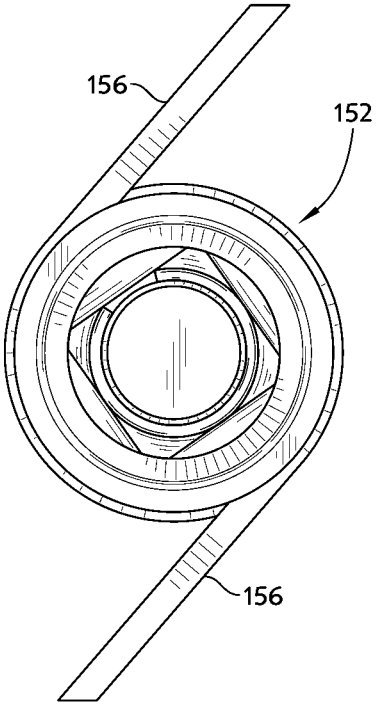
FIG. 12 is a top elevation view depicting an anvil of a fourth embodiment of a lubrication system.

Turning to FIGS. 11 and 12, anvils 150, 152 of additional illustrative embodiments of alternative lubrication systems are depicted. The anvils 150, 152 may include blades 154, 156, respectively, that are generally linear and that may extend at an angle from the respective anvil 150, 152. The blades 154 of the anvil 150 may be bi-directional and may create a flow of lubricating fluid similar to that described above with respect to the anvil 132 of FIGS. 9 and 10. Similarly, the blades 156 of the anvil 152 may be unidirectional and may create a flow of lubricating fluid similar to that described above with respect to the anvil 26 of FIGS. 5-8.

Figure 13:
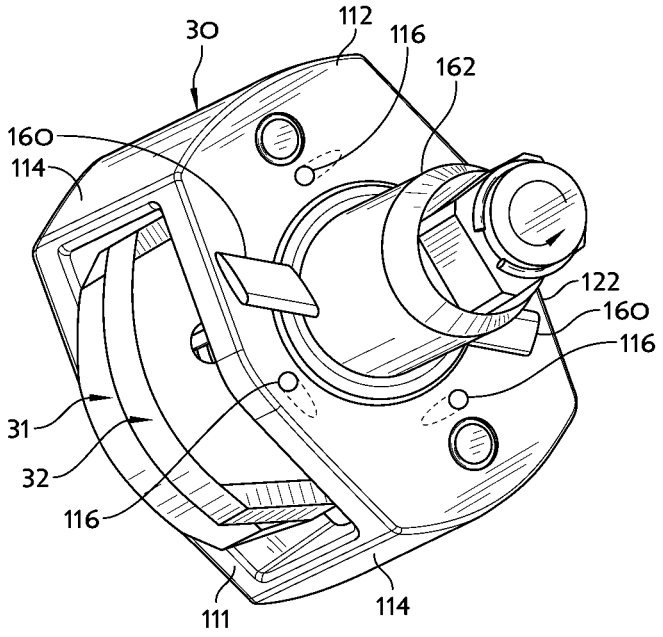
FIG. 13 is a top perspective view of a fifth embodiment of a lubrication system.
Figure 14:
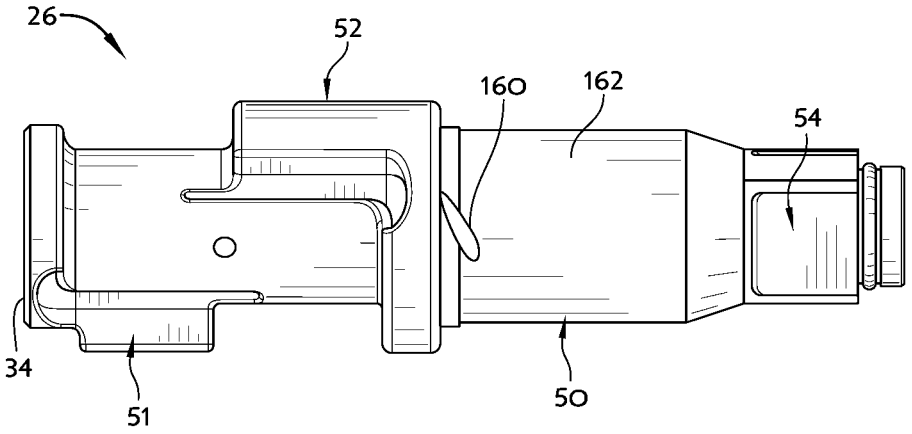
FIG. 14 is a side elevation view depicting an anvil of the fifth embodiment.

A further embodiment of a lubrication system is depicted in FIGS. 13 and 14. The lubrication system is similar to the previously described lubrication systems except that blades 160 extending from an anvil 162 are differently shaped. More specifically, the blades 160 are generally planar and angled with respect to the forward support 112 of the carrier 30. The blades 160 also have a lesser axial extent in that the blades 160 are shorter and extend along less of an axial extent of the anvil 162. The blades 160 may be unidirectional or bi-directional and may incorporate any of the characteristics or features of any of the blades described herein.

Figure 15A:
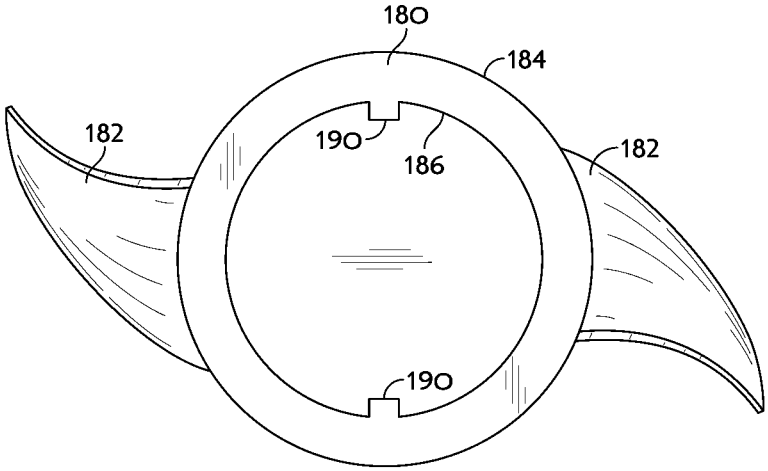
FIG. 15A is a cross-sectional view of a ring including opposing blades for moving lubricating fluid through the passages in the carrier, wherein the ring includes a keyed structure for attachment to the anvil.
Figure 15B:
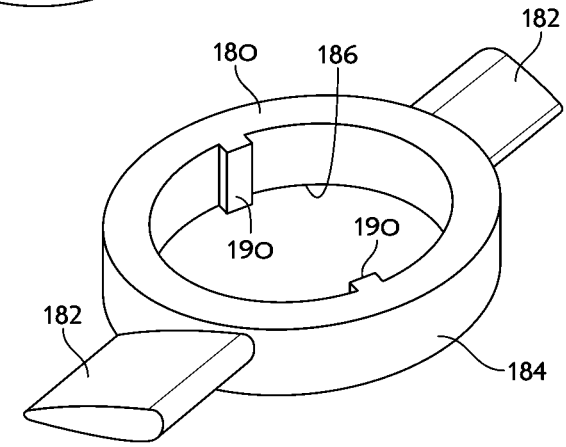
FIG. 15B is a top perspective view of the ring of FIG. 15A.
Figure 15C:
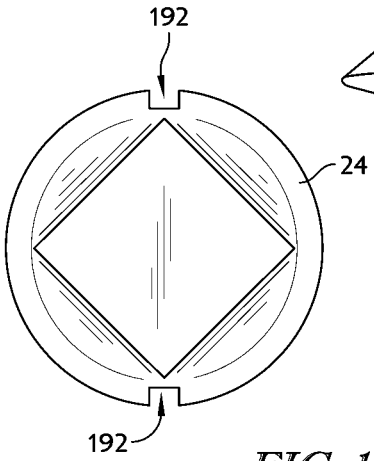
FIG. 15C is a cross-sectional view of the anvil with a keyed structure that mates with the keyed structure of the ring of FIGS. 15A and 15B.

The blades of any of the embodiments herein may be formed integrally with the anvil or may, in an illustrative embodiment, be attached to a ring 180 that is inserted over the distal end 36 of the anvil 26. In illustrative embodiments, as seen in FIGS. 15A and 15B, the ring 180 may include any number of blades 182 extending outwardly from an outer surface 184 of the ring 180, wherein the blades 182 may be formed in accordance with any of the embodiments disclosed herein or any other suitable blade. An inner surface 186 of the ring 180 may include a keyed structure 190, such as one or more projections and/or grooves that interact with a keyed structure 192 on the anvil 26, as seen in FIG. 15C. The keyed structure 192 may similarly be one or more opposing grooves and/or projections that align and guide the ring 180 onto the anvil 26. In alternative embodiments, the keyed structures 190, 192 may be any structures that align and guide the ring 180 onto the anvil 26. In an illustrative embodiment, the ring 180 and/or the anvil 26 may also include a structure that selectively retains the ring 180 on the anvil 26 in an axial direction (parallel to the output axis 42).

In further illustrative embodiments, a set of blades may be press fit onto the anvil or may be floating around a hex or square. In such embodiments, the anvil may include upstream or downstream components that limit axial motion of the blades.

Figure 16A:
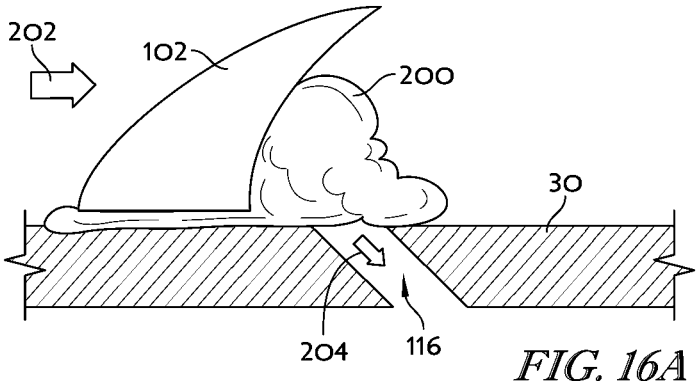
FIGS. 16A-16C are cross-sectional views of an exemplary blade of any of the lubrication systems disclosed herein as it passes over a channel in the carrier and pushes a lubricating fluid through the channel.
Figure 16B:
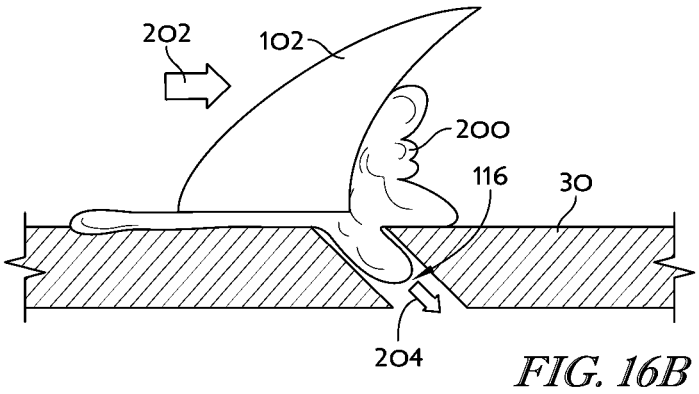
Figure 16C:
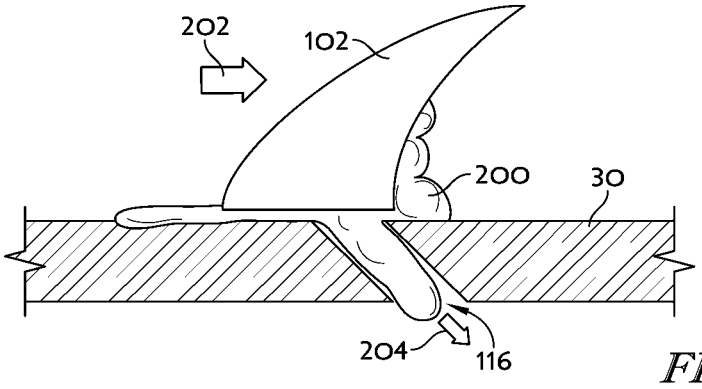

Referring to FIGS. 16A-16C, as any of the blades, illustratively blade 102, passes over a passage 116, some or all of the lubricating fluid 200 may be pulled in toward the anvil and down into the passage 116. As the blade 102 moves in a direction 202 and nears the passage 116, as suggested in FIG. 14A, the lubricating fluid 200 is pushed in the direction 202. As the blade 102 begins to pass over the passage 116, as suggested by FIG. 14B, some or all of the lubricating fluid 200 may be pushed downwardly into the passage 116 in direction 204. In an illustrative embodiment, some of the lubricating fluid 200 may be pushed outwardly, pushed with the blade 102 over the next passage 116, or may move under the blade 102 if there is enough clearance between the blade 102 and the carrier 30. The lubricating fluid 200 continues to move through the passage 116 in the direction 204, as the blade 102 passes fully over the passage 116, as suggested in FIG. 14C. In the illustrative embodiment of FIGS. 14A-14C, the passages 116 are angled in the direction 202, as discussed in detail above, so as to facilitate movement of the lubricating fluid 200 through the passages 116.

While a particular number and shapes of blades are shown and described herein, various other embodiments are envisioned. More specifically, the blades may have any suitable number of blades and the blades may have any suitable shape(s) and/or dimensions that allow the blade(s) to pull the lubricating fluid in and down and/or creates an eddy current may be used. In illustrative embodiments, the blades may be made of metal, plastic, or any other suitable material. Similarly, while a particular impact tool 10 and drive train 20 have been disclosed herein, one skilled in the art will understand that the principles of the disclosed illustrative embodiments may be incorporated within other impact tools 10 and/or drive trains 20. Furthermore, although directional terminology, such as aft, forward, downwardly, inwardly, etc. may be used throughout the present specification, it should be understood that such terms are not limiting and are only utilized herein to convey the orientation of different elements with respect to one another.

While certain illustrative embodiments have been described in detail in the figures and the foregoing description, such an illustration and description is to be considered as exemplary and not restrictive in character, it being understood that only illustrative embodiments have been shown and described and that all changes and modifications that come within the spirit of the disclosure are desired to be protected. There are a plurality of advantages of the present disclosure arising from the various features of the apparatus, systems, and methods described herein. It will be noted that alternative embodiments of the apparatus, systems, and methods of the present disclosure may not include all of the features described yet still benefit from at least some of the advantages of such features. Those of ordinary skill in the art may readily devise their own implementations of the apparatus, systems, and methods that incorporate one or more of the features of the present disclosure.

The invention claimed is:

1. A rotary impact tool comprising:

a motor including a rotor and an input shaft coupled to the rotor for rotation with the rotor about an input axis;

an anvil being rotatable about an output axis and including an output shaft;

a carrier driven by the input shaft, the carrier having a passage extending through a distal end of the carrier; and a hammer supported and driven by the carrier and configured to impact the anvil to cause the anvil to rotate about the output axis;

wherein the anvil comprises a blade coupled to the output shaft at an exterior of the carrier and distally from the carrier, the blade directing a lubricating fluid through the passage when the anvil or carrier rotates about the output axis.

2. The rotary impact tool of claim 1, wherein the passage extends between a first surface and a second surface of a support at the distal end of the carrier, the passage extending at an angle of about 25 degrees to about 45 degrees with respect to the first surface.

3. The rotary impact tool of claim 1, wherein the carrier includes a plurality of passages extending through the distal end thereof.

4. The rotary impact tool of claim 1, wherein the blade includes a leading surface and a trailing surface and is configured such that, when the anvil rotates in a first direction, the leading surface leads to move lubricating fluid inwardly toward the leading surface and into the passage.

5. The rotary impact tool of claim 4, wherein the anvil further comprises a second blade coupled to the output shaft diametrically opposite the blade, the second blade including a second leading surface and a second trailing surface.

6. The rotary impact tool of claim 5, wherein the second blade is configured such that, when the anvil is rotated in the first direction, the second leading surface of the second blade leads to move lubricating fluid inwardly toward the second leading surface and into the passage.

7. The rotary impact tool of claim 5, wherein the second blade is configured such that, when the anvil is rotated in the first direction, the second trailing surface leads and, when the anvil is rotated in a second direction opposite the first direction, the second leading surface leads.

8. The rotary impact tool of claim 1, wherein the blade extends outwardly relative to the anvil and is configured such that, when the anvil is rotated in a first direction, lubricating fluid is moved inwardly between the blade and the anvil and into the passage.

9. The rotary impact tool of claim 1, wherein the blade is substantially planar and positioned at an angle with respect to a first surface of a support at the distal end of the carrier.

10. The rotary impact tool of claim 1, wherein the blade extends outwardly from a ring having a central keyed passage that mates with a keyed structure on the anvil.

11. A drive train comprising:

an input shaft rotatable about an input axis;

an anvil being rotatable about an output axis, the anvil including an output shaft;

a carrier driven by the input shaft, the carrier having a passage extending through a distal end of the carrier; and an impactor including a hammer supported and driven by the carrier and configured to impact the anvil to cause the anvil to rotate about the output axis;

wherein the anvil comprises a blade coupled to the output shaft at an exterior of the carrier and distally from the carrier, the blade directing a lubricating fluid through the passage when the anvil or carrier rotates about the output axis.

12. The drive train of claim 11, wherein the blade includes a concave surface and a convex surface and is configured such that, when the anvil rotates in a first direction, the concave surface leads to move lubricating fluid inwardly toward the concave surface and into the passage.

13. The drive train of claim 12, wherein the anvil further comprises a second blade diametrically opposite the blade, the second blade including a second concave surface and a second convex surface.

14. The rotary impact tool of claim 13, wherein the second blade is configured such that, when the anvil is rotated in the first direction, the second concave surface of the second blade also leads to move lubricating fluid inwardly toward the second concave surface and into the passage.

15. The rotary impact tool of claim 13, wherein the second blade is configured such that, when the anvil is rotated in the first direction, the second convex surface leads and, when the anvil is rotated in a second direction opposite the first direction, the second concave surface leads.

16. The drive train of claim 11, wherein the blade extends outwardly relative to the anvil and is configured such that, when the anvil is rotated in a first direction, lubricating fluid is moved inwardly between the blade and the anvil and into the passage.

17. The drive train of claim 11, wherein the blade extends outwardly from a ring having a central keyed passage that mates with a keyed structure on the anvil.

* * * * *